US006029435A

United States Patent [19]

Okamoto

[11] Patent Number: 6,029,435

[45] Date of Patent: Feb. 29, 2000

[54] THREADING APPARATUS

[75] Inventor: Akira Okamoto, Jouyou, Japan

[73] Assignee: Murata Kikai Kabushiki Kaisha, Kyoto, Japan

[21] Appl. No.: 09/063,826

[22] Filed: Apr. 22, 1998

[30] Foreign Application Priority Data

Apr. 24, 1997 [JP] Japan ..... 9-106897

[51] Int. Cl.[7] ..... D01H 11/00

[52] U.S. Cl. ..... 57/261; 57/279; 57/280; 57/333

[58] Field of Search ..... 57/261, 279, 280, 57/333

[56] References Cited

U.S. PATENT DOCUMENTS

| | | | |
|---|---|---|---|
| 4,114,356 | 9/1978 | Eckhardt | 57/81 X |
| 4,340,341 | 7/1982 | Cardell | 425/72 |
| 4,655,988 | 4/1987 | Shinmoto et al. | 264/566 |
| 5,088,264 | 2/1992 | Bartkowiak | 57/280 |
| 5,159,806 | 11/1992 | Mori et al. | 57/333 X |
| 5,295,349 | 3/1994 | Okamoto | 57/333 |
| 5,813,209 | 9/1998 | Hirao et al. | 57/279 |

FOREIGN PATENT DOCUMENTS 8-11625 2/1996 Japan .

*Primary Examiner*—William Stryjewski
*Attorney, Agent, or Firm*—Armstrong, Westerman, Hattori, McLeland and Naughton

[57] ABSTRACT

To provide a threading apparatus that can thread yarn by feeding compressed air when the yearn is fed from a large diameter portion of a spindle member to a small diameter portion of the spindle member preceding the large diameter one. A spindle member is divided and a pipe including of a filter member is installed in the middle of the spindle, so that when compressed air is injected from the rear end of the spindle member having a large diameter toward its tip having a small diameter and preceding the rear end, a suction flow that sucks external air at the rear end is generated while excessive air is discharged to the exterior through the filter member, thereby maintaining a yarn feeding air flow in the center of the spindle member. Thus, the present invention can provide a threading apparatus that can feed compressed air to thread yarn from the rear end having a large diameter toward the preceding small diameter portion.

7 Claims, 6 Drawing Sheets

THREADING APPARATUS

FIELD OF THE INVENTION

The present invention relates to a threading apparatus for feeding yarn that can be used throughout the textile industry, and in particular to a threading apparatus that is used for a spindle section of an air spinning machine that manufactures spun yarn by twisting non-twisted fiber bundles drafted by a draft device by allowing a whirling air flow to act on the fiber bundles.

BACKGROUND OF THE INVENTION

Conventional threading apparatuses for feeding yarns feed yarn on a suction flow generated by compressed air injected through a path with a uniform diameter or from a small diameter path to a large diameter path. In addition, when yarn is fed from the large diameter path toward the small diameter path, the above compressed air method may cause air to flow in the opposite direction to prevent a suction flow from being generated, thereby hampering threading. Thus, an air sucker is installed at an outlet of the small diameter path preceding the large diameter path in order to obtain a suction force.

Consequently, when spinning is begun or a yarn is cut, a conventional spinning machine uses a suction member to suck the end of the yarn wound around a package, and then uses a roller to grip the end in order to transfer it to the rear end of a spindle in a spinning section. When inserting the end of the yarn into a yarn path in the spindle, the spinning machine engages the air sucker with the tip of the spindle while feeding the yarn using the roller, guides the end of the yarn to the front of the spindle using a suction flow from the air sucker, and pieces together the end of the yarn and slivers fed from a draft device located on the upstream side.

It is an object of the present invention to provide a yarn feeding apparatus that does not require an air sucker as is required by the conventional spinning machine and that blows compressed air from the rear of a spindle to enable yarn to be threaded from the rear end of the spindle, which has a large diameter, toward its small diameter portion.

SUMMARY OF THE INVENTION

To achieve this object, the present invention is characterized in that, when compressed air is used to feed yarn from a large diameter path to a small diameter path, a filter member is provided in the middle of the yarn path. Thus, when compressed air is injected from the large diameter path toward the small diameter path, the excess air flow is discharged to the exterior through the filter member to prevent a counterflow in order to preserve the yarn feeding air flow in the middle of the path, thereby enabling the yarn to be fed toward the small diameter portion.

The present invention is also characterized in that the outside of the filter member is covered with a porous cover. Thus, even if the length of the filter member is increased to increase its surface area, the amount of air discharged to the exterior can be adjusted by increasing or reducing the pore area of the external porous cover, thereby maintaining at a constant force the yarn feeding air flow formed in the middle of the yarn path. In addition, since the length of the filter member can be increased, clogging will not to occur, so that function degradation is prevented.

Furthermore, the present invention is characterized in that the threading apparatus is installed in a spindle member of an air spinning machine. Thus, since the threading apparatus can be used as the spindle section of the conventional air spinning machine, threading can be achieved by blowing compressed air from the rear end of the spindle without the use of the air sucker that is required in conventional threading.

DETAILED DESCRIPTION OF THE PREFERRED EMBODIMENTS

Embodiments of the present invention are described below in detail with reference to FIGS. 1 to 6.

Figure 6:
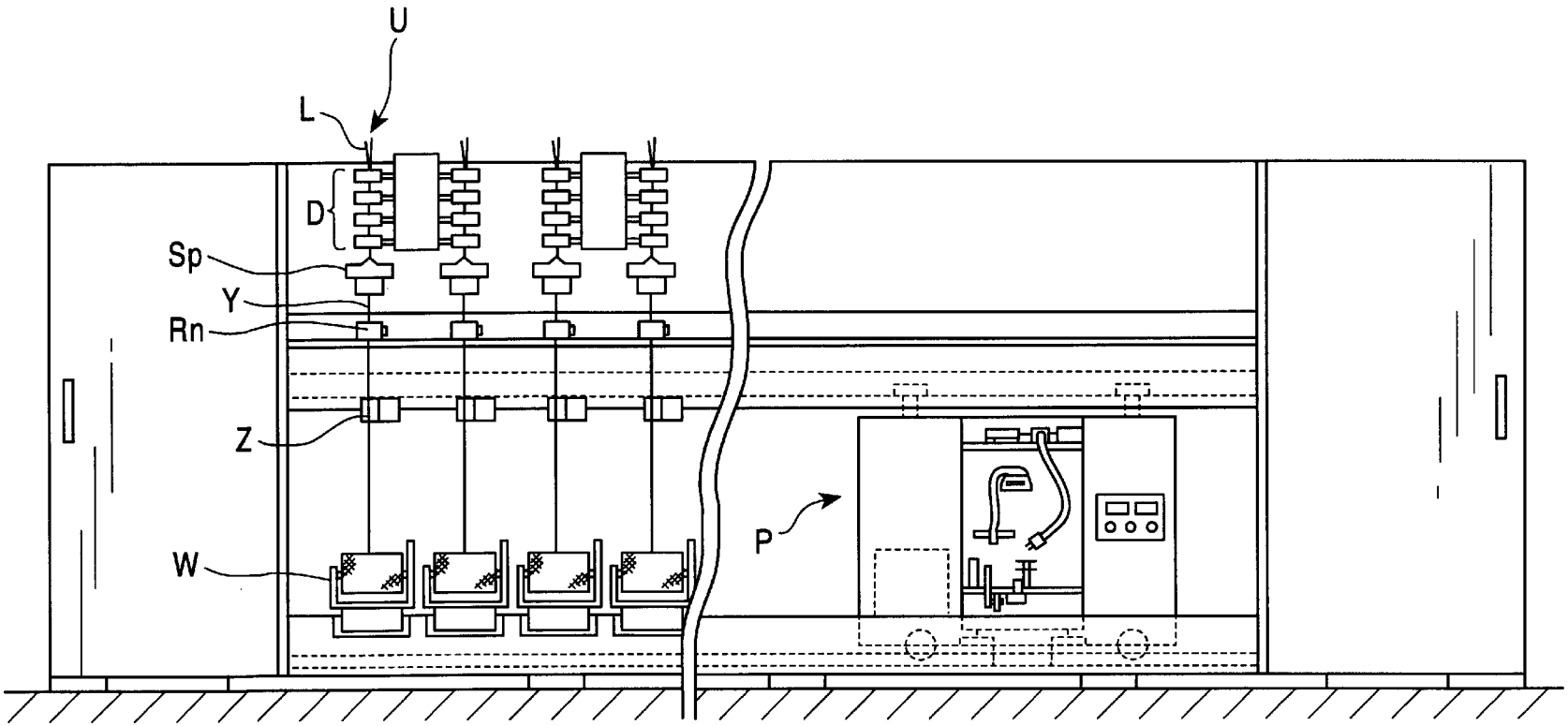
FIG. 6 is a front view of the overall spinning machine to which the present invention is applied.

First, the spinning machine and spinning section to and the present invention is applied, are described. The present spinning machine, is composed of a large number of spinning units U, as shown in FIG. 6. A sliver L is fed to a draft device D, in which it is formed into spun yarn Y by a spinning section Sp. The spun yarn Y then passes through a nip roller Rn and a slub catcher Z, and is wound around a winding section W. P is a piecing apparatus for performing a piecing operation, which is configured to travel at the bottom of the interior of the spinning machine along its longitudinal direction.

Figure 4:
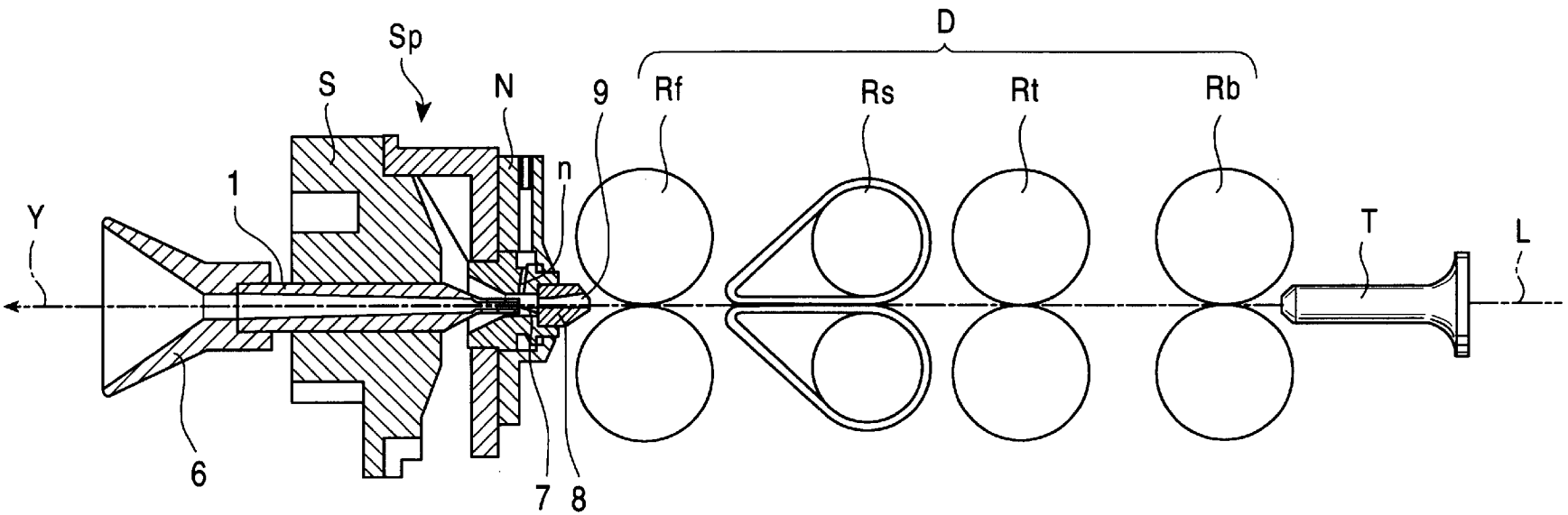
FIG. 4 PRIOR ART
FIG. 4 is a sectional view of a spinning machine to which a conventional spindle member is applied.

The spinning machine to which the present invention is applied is composed of the draft device D and spinning section Sp, as shown in FIG. 4. The draft device D is a four-line draft device consisting of a rear roller Rb, a third roller Rt, a second roller Rs having an apron, and a front roller Rf. Each roller consists of a pair of rollers. The draft device D drafts the sliver L supplied via a sliver guide T, to a specified thidcness and performs a draft operation when the rotating speed of each roller is gradually increased.

The sliver L, which has been drafted to the specified thickness while passing through the draft device D, is supplied to the spinning section Sp consisting of a nozzle member N and a spindle member S', in which it is formed into spun yarn Y. The spinning section Sp is composed of the nozzle m r N having air nozzles n that cause a whirling air flow to act on a fiber bundle output from the draft device D. A spindle member 1*a* has its tip located at a point at which the whirling air flow from the nozzle member N acts and a hollow portion that acts as a yarn path. A guide member 7, has a tip of which protrudes toward an inlet of the spindle 1*a*. The spindle meeber S' includes a stationary spindle 1*a* which has a yarn path formed in its center, and the nozzle member N has a plurality of air nozzles n that are drilled in the tangential direction and from which compressed air is injected toward the tip of the spindle to generate a whirling air flow in order to form the spun yarn Y.

The fiber bundle output from the front roller Rf in the draft device is drawn into a casing through a hole 9 in a supporting part 8 for the guide member 7 by means of a suction flow generated by the action of the air flow from the air nozzles n. While the fiber bundle is being formed into yarn, the front ends of all fibers in the fiber bundle are drawn from the periphery of the guide member 7 and guided to the yarn path 1*b* in the spindle 1*a*. In addition, the rear ends of the fibers are reversed from the tip of the spindle 1*a* by both the suction flow and the whirling air flow from the air nozzles n, and the fibers are mutually separated.

The separated fibers are exposed to the whirling air flow from the air nozzles n, and are guided into the spindle 1*d* while being spirally wound around the fiber bundle being formed into yarn, resulting in true twisted spun yarn. The guide member 7 acts as a pseudo-core by preventing twisting from being propagated during the formation of yarns or temporarily acting as a central fiber bundle, thereby hampering the formation of non twisted core fibers, which frequently occur in conventional air-binding spun yarn, in order to form yarn with virtually only wound fibers.

As described above, the fibers separated at the tip of the spindle 1*a* are formed into spun yarn by being drawn into the yarn path in the middle of the spindle while being swung (ballooned) by the whirling air flow. Thus, the tip of the spindle 1*a* has an optimal bore diameter relative to the diameter of a spun yarn. In the experiment in which the effectiveness of the present invention was verified, the bore diameter ϕ was 1.1 mm relative to the diameter of the spun yarn Ne 20 to 40. The bore diameter of a spun yarn outlet at the rear end of the spindle 1*a* is larger. The difference in bore diameter improves the spinning capability and enables the end of the yarn drawn out from a package to be introduced from the rear end of the spindle 1*d* during piecing.

Figure 5:
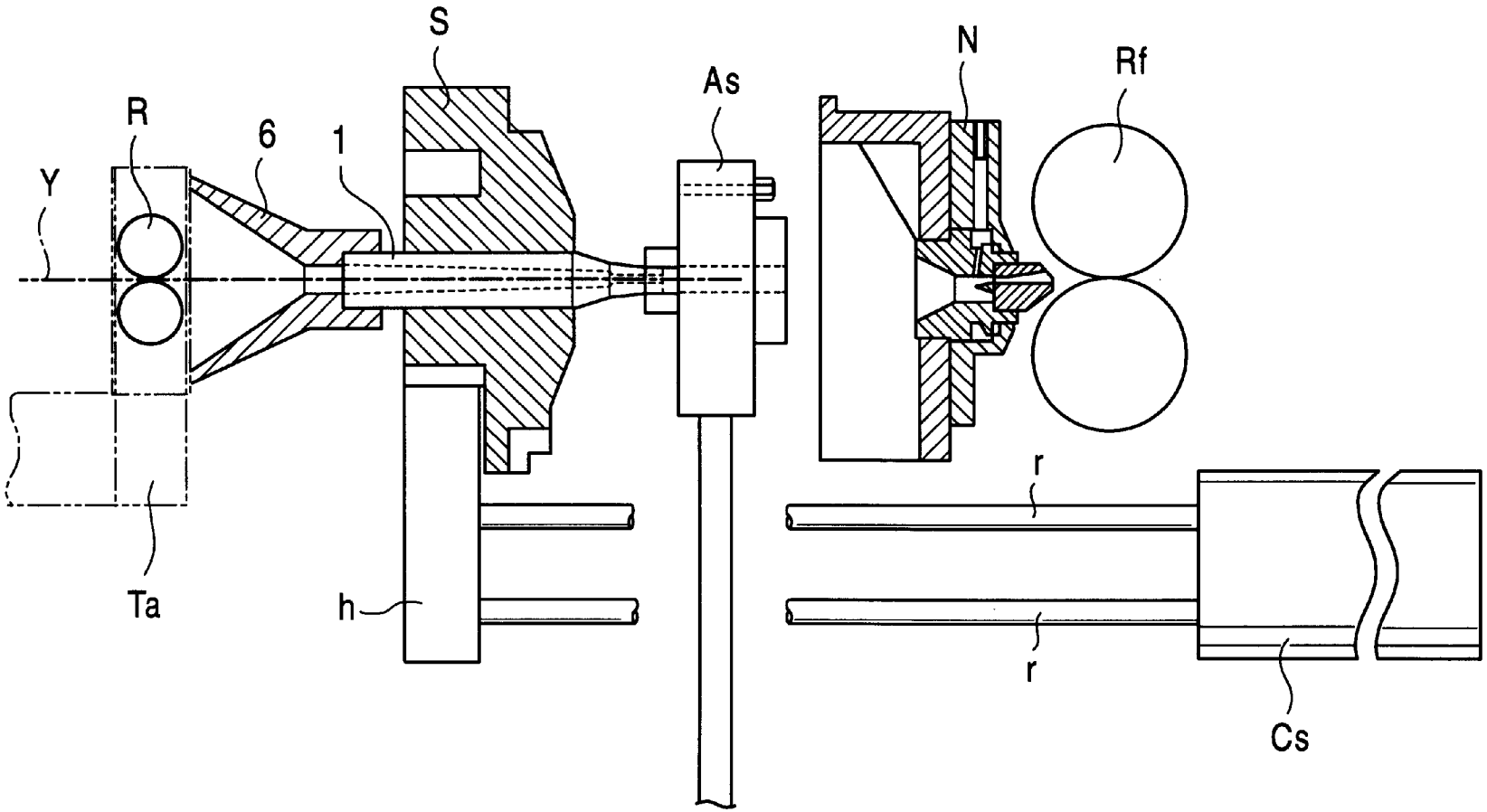
FIG. 5 PRIOR ART
FIG. 5 is a sectional view showing the piecing operation of a conventional spinning section.

When the yarn is cut during spinning by the conventional spinning machine, the spindle member S supported by a supporting member h is separated from the nozzle member N using an air cylinder Cs having connecting rods r connected to the supporting member; to engage an air sucker member As with the tip of the spindle 1, as shown in FIG. 5. In addition, by feeding the yarn using a feed roller R in a transfer apparatus Ta that transfers the spun yarn Y drawn from a padcage (not shown in the drawings), and sucking the yarn using the air sucker member As, the end of the yarn is guided to the front of the spindle members, and subsequently, it is combined with the sliver L that has been drafted passed by being through the draft device D to the specified thickness. Winding is then begun to carry out piecing. This operation, however, is not described in detail.

The present invention, that enables yarn to be threaded into the spindle member S without the use of the air sucker required for the conventional threading method, is described.

As shown in Figure member S, the spindle member S' is segmented and comprises a spindle 1*a* at its tip, a conduit 4 and a holder 5 separated from the spindle 1*a* by a distance k, and a funnel-shaped tube 6 at its rear end. The circumference of the spindle member S' is covered a porous member 3. A pipe 2 consisting of a sintered metal element, commonly used for a silencer or a filter for an air pressure member, is installed in the middle of the spindle member S' as a filter member, so compressed air supplied from an air supply hole 5*a* advances without a counterflow and is injected toward the tip of the spindle from a fine gap 6*a* between the holder 5 and the funnel-shaped tube 6 at the rear end. Most of the air from air supply hole 5*a*, however, is discharged from the gap k to the exterior through the filter member 2. Since the porous member 3 has a plurality of fine pores 3*a*, the discharge of the supplied air progresses very slowly. Thus, the air flowing through the middle region of the spindle member S' enters the spindle 1*a* is held and is discharged to the exterior after passing through the yarn path 1*b* at the tip of the spindle. In this manner, the amount of air discharged to the exterior through the filter member 2 and the amount of air discharged to the exterior through the yarn path at the tip of the spindle can be varied according to the number of fine pores 3*a* in order to adjust the capability of transferring the yarn Y through the yarn path 1*b* in the spindle 1*a*.

The injection of air from the fine gap 6*a* between the holder 5 and the funnel-shaped tube 6 at the rear end produces an air sucker effect to generate a suction flow that sucks air from outside the funnel-shaped tube 6 into the spindle member S'. The conduit 4 acts as a tube for straightening the flow of air in the middle of the conduit 4 and creats a path for the sucked external air. That is, the end of the yarn introduced, together with the sucked external air flow from the rear end of the spindle moves through the middle of the conduit 4.

Figure 2:
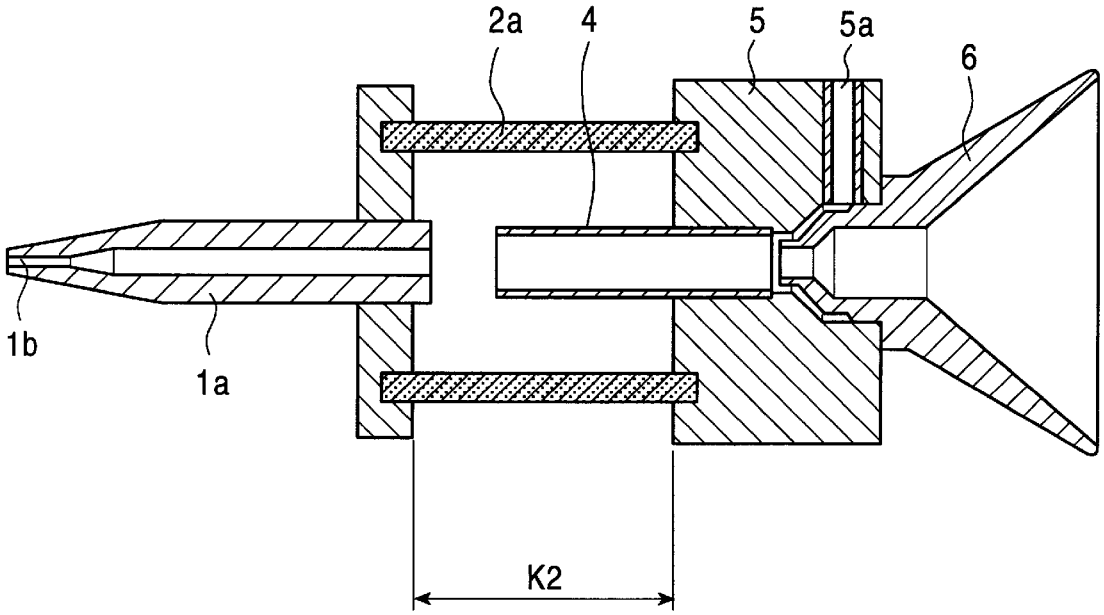
FIG. 2 is a sectional view showing a second embodiment of a spindle member according to the present invention.

Alternativly, only a pipe 2*a* consisting of a filter member may be used without using the porous member 3, as shown in FIG. 2. In this case, however, the length K2 of the filter section must be reduced to reduce its surface area. If the length of the filter section is too great, the amount of released air increases to reduce the force of the air flow that transfers the end of the yarn through the middle of the spindle, thereby preventing threading.

Figure 3:
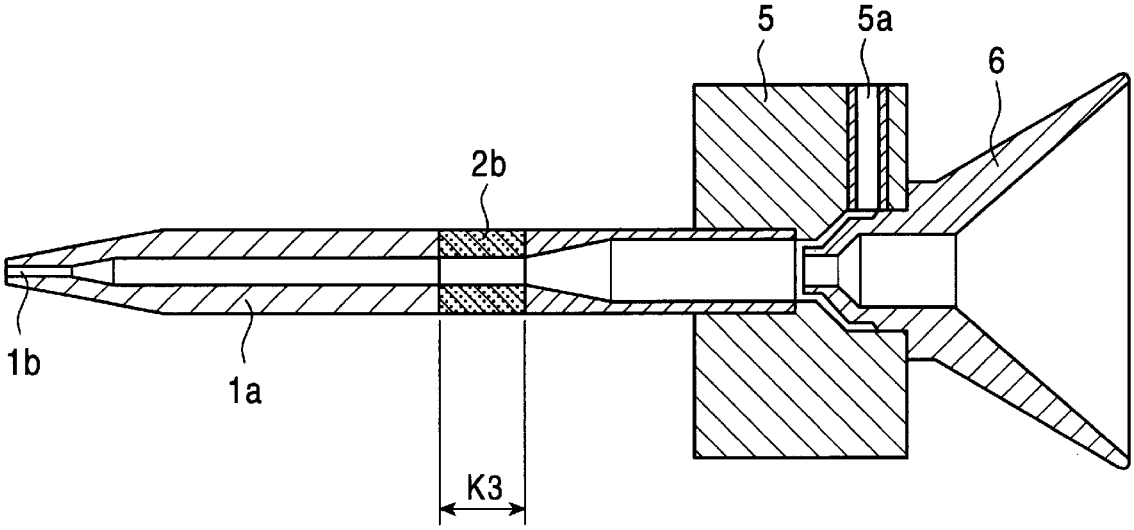
FIG. 3 is a sectional view showing a third embodiment of a spindle member according to the present invention.

In addition, if a pipe 2*b* consisting of a filter member of a length K3 is provided in part of the spindle 1, as shown in FIG. 3, a sufficient threading effect can be obtained from the air injected from the air supply hole 5*a*.

Figure 1:
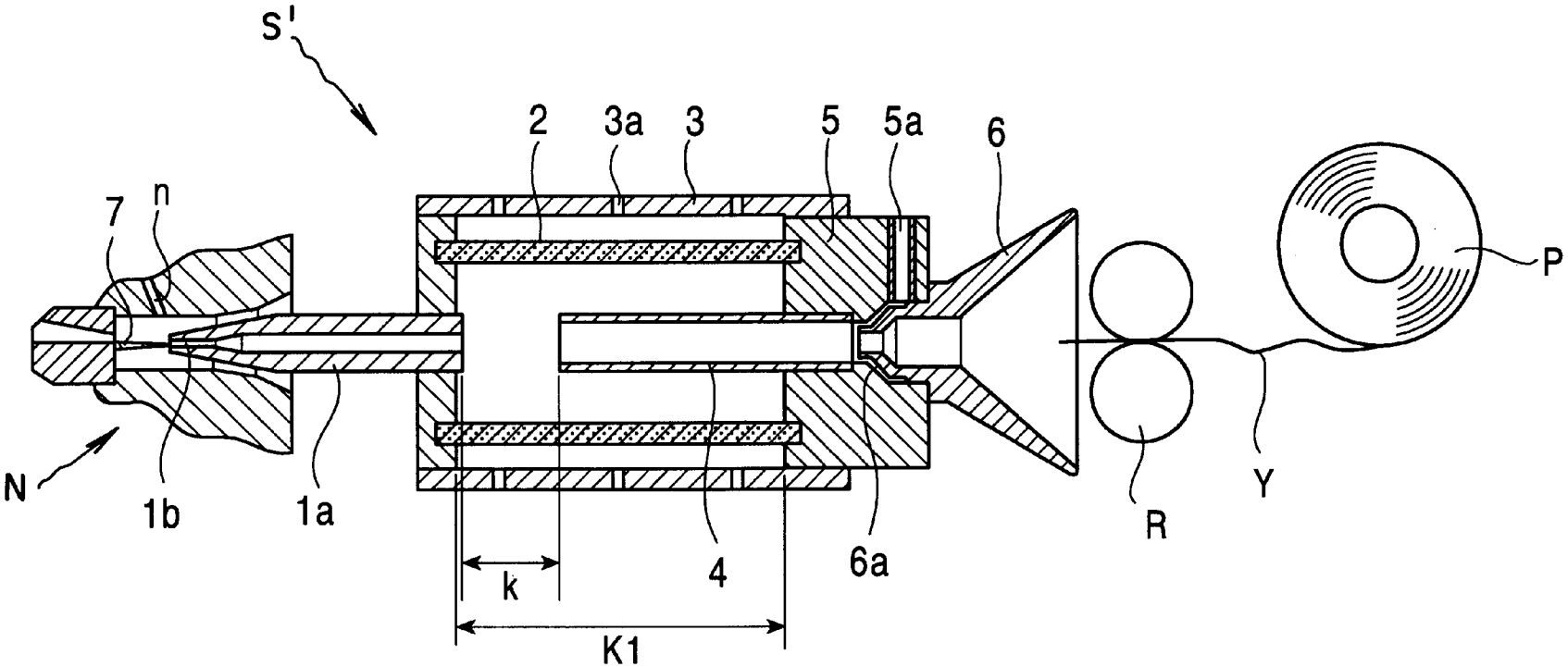
FIG. 1 is a sectional view showing the structure of a spindle member according to the present invention.

Although threading can be achieved by the configuration shown in FIGS. 2 or 3, it requires that the length K2 or K3 of the filter section be reduced. Consiquently a porous member more 3 desirably covers the outside of the pipe 2 consisting of the filter member in order to allow length K1 of the filter section to be increased, as shown in FIG. 1. This configuration can increase the life expectancy of the apparatus by preventing clogging of the filter member that obstructs the passage of air, thereby enabling the hereindescribed spindle structure to be used in the current spinning machine.

The present invention uses a sintered metal element as the filter mr. In an experiment on the flow of air, when 85 liters/minute of air was diverted at an air pressure of 4 $kg/cm^2$, 14 liters/minute of air was sucked from the rear end of the spindle and 20.5 liters of air flowed from the tip of the spindle. That is, the leakage from the filter embr to the exterior was 78.5 liters. In this case, 24 fine pores 3*a* were provided in the porous member 3 and had a bore diameter of ϕ 0.6 mm. When the number of pores 3*a* at a bore diameter was increased to 32 and 85 liters/minute of air was diverted-at an air pressure of 4 $kg/cm^2$, as described above, 19 liters of air was sucked from the rear end of the spindle and 19.5 liters of air flowed from the tip of the spindle. Thus, the nuiber of pores 3*a* could be varied to adjust the flow of air through the yarn path in the spindle. The material of the filter member is not limited to the sintered metal element but may be fibers, resin, or ceramics, as long as it is porous and releases air slowly.

As described above, in the present invention the spindle member S' is divided and the pipe 2 comprising of the filter member is installed in the middle of the spindle member S', so that when compressed air is injected from the rear end of the spindle member having a large diameter toward its tip containing yarn path 1*b* having a small diameter and preceding the rear end, a suction flow that sucks external air at the rear end through tube 6 is generated while excessive air is discharged to the exterior through the filter member 2 or 2*a* thereby maintaining a yarn transferring air flow in the center of the spindle member S'. Thus, when spun yarn is fed from the funnel shaped tube 6 at the rear end of the spindle member having a large diameter toward the tip of spindle 1*d* having a small diameter, compressed air can be blown from the rear end having a large diameter to transfer the spun yarn Y by means of a suction flow from the rear end having a large diameter, toward the tip having a small diameter, instead of a suction force from the tip of the spindle. In addition, since the outside of the pipe 2 consisting of the filter member is covered with the porous member 3, the spun yarn Y can be threaded appropriately even if the length of the filter member is increased, thereby preventing the filter member from being clogged to increase the life expectancy of the apparatus.

I claim:

1. A spinning machine comprising a draft device, a nozzle member having a hollow interior and containing a compressed air injector for producing a whirling air flow on a fiber bundle supplied from said draft device to produce spun yarn, and a spindle member including a a spindle having a yarn path formed therein though which said spun yarn is conducted, wherein a fiber bundle inlet of the yarn path in said spindle is diagnosed within the interior of said nozzle member in concentrically spaced relation thereto to define a passage for the discharge of air from the interior of said nozzle member, said spindle containing a spun yarn outlet having a smaller inner diameter than that of said spun yarn inlet, and said spindle member containing a rearward end spaced from said spun yarn outlet of said spindle for receiving spun yarn to be conducted through said spun yarn outlet of said spindle to the fiber bundle inlet thereof for piecing in said nozzle interior, an air supply hole for injecting air to induce an air flow into the rearward end of said spindle member for conducting said spun yarn for piecing, said spindle member containing a discharge region formed in an intermediate part of said yarn path between said rearward end and said spun yarn outlet of said spindle, said discharge region containing means for discharging from said yarn path to the exterior of said spindle member some of the air injected by said air supply hole.

2. A spindle member for a treading apparatus as recited in claim 1 wherein said spindle member is segmented, and in that the segmented part is covered with a filter member formed of a porous material to define an air discharge chamber.

3. A spindle member for a threading apparatus as recited in claim 2 wherein the outside of said filter member is further enclosed by a cover having an air discharge hole operative to adjust the flow of air discharged from the spindle member.

4. A threading apparatus that uses a spindle member having an interior defining paths of different diameters to pass yarn from a large diameter path toward a small diameter path, said spindle member comprising:

a forward end containing said small diameter path and a rearward end containing said large diameter path, means for injecting compressed air from said large diameter path toward said small diameter path, a discharge region disposed intermediate said large diameter path and said small diameter path and operative to conduct yarn within a flow of said injected compressed air from said large diameter path to said small diameter path, and said discharge region contact a filter member and being operative to discharge some of the injected compressed air to the exterior of said spindle member.

5. A spindle member for a threading apparatus as recited in claim 4 wherein said filter member is formed of a porous material.

6. A spindle member for a threading apparatus as recited in claim 5 wherein the outside of said filter member is covered with a porous cover operative to adjust the flow of air discharged from the spindle member.

7. A spindle member for a threading apparatus as recited in any one of claims 2, 3, 5 and 6 wherein said filter member is a sintered metal element.

* * * * *